United States Patent [19]

Bruno

[11] Patent Number: 4,969,239

[45] Date of Patent: Nov. 13, 1990

[54] SKI GOGGLE ARM CLIP

[76] Inventor: Adrian A. Bruno, 2509 Millcreek La., Rolling Meadows, Ill. 60008

[21] Appl. No.: 332,036

[22] Filed: Apr. 3, 1989

[51] Int. Cl.[5] ..... A44B 21/00

[52] U.S. Cl. ..... 24/3 C; 24/13; 24/306

[58] Field of Search ..... 24/3 R, 3 F, 3 A, 3 C, 24/6, 15, 13, 306, 442, 356; 224/901, 250, 264, 182, 194; 2/DIG. 6; 128/DIG. 15

[56] References Cited

U.S. PATENT DOCUMENTS

| | | | |
|---|---|---|---|
| 539,101 | 5/1895 | Troop | 24/6 |
| 668,897 | 2/1901 | Weiller | 24/6 |
| 1,210,957 | 1/1917 | Lewy | 24/6 |
| 1,533,169 | 4/1925 | Donohue | 24/6 |
| 1,816,714 | 7/1931 | Adler | 24/6 |
| 4,055,873 | 11/1977 | Kallman | 24/36 |
| 4,168,544 | 9/1979 | Kallman | 224/901 X |

*Primary Examiner*—James R. Brittain

*Attorney, Agent, or Firm*—Paul H. Gallagher

[57] ABSTRACT

The clip is made up of a back strap and securing strap, respectively of hook and loop materials that are secured together by merely fitting them face-to-face. The back strap includes a back flap and a front flap, and the securing strap is fitted to the outer opposed surfaces of the back and front flaps of the back strap and the goggles are held between the back flap and the front flap, with the front strap surrounding the bridge of the goggles. The back strap is secured to the sleeve of the jacket of the wearer and the curvature of the goggles follow the curvature of the arm.

6 Claims, 1 Drawing Sheet

Fig. 1
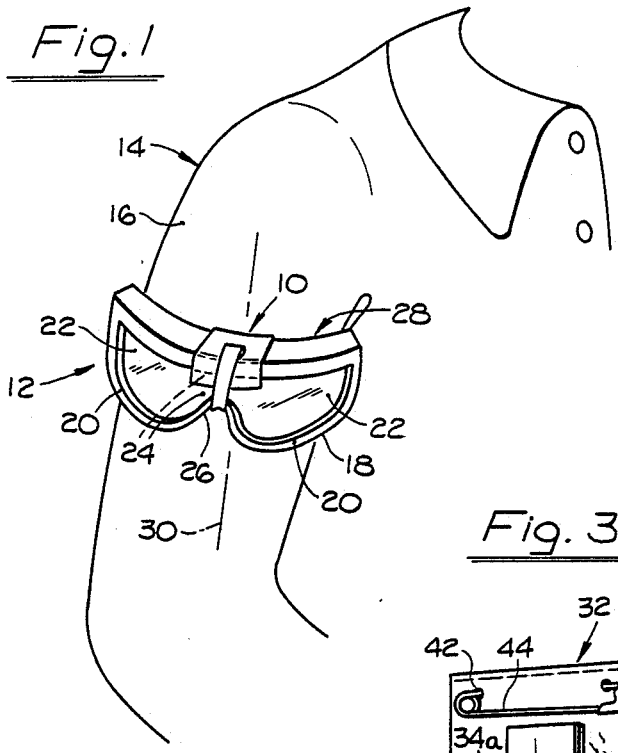
Fig. 2
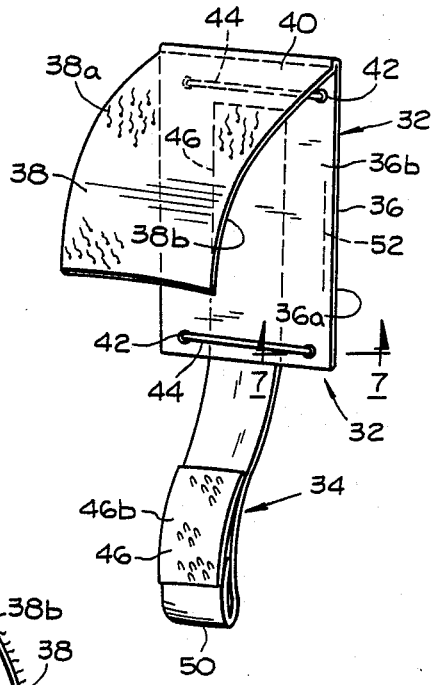
Fig. 3
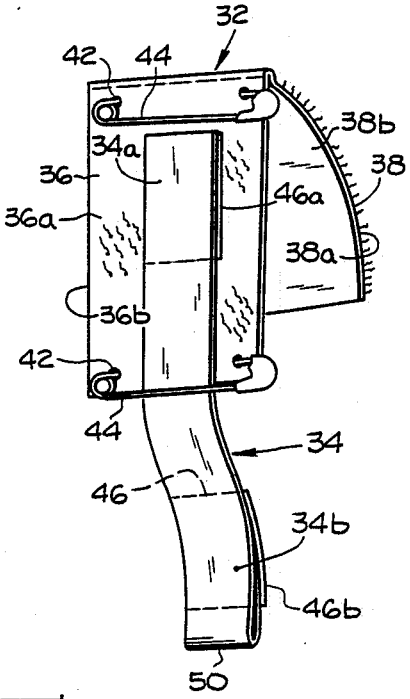
Fig. 4
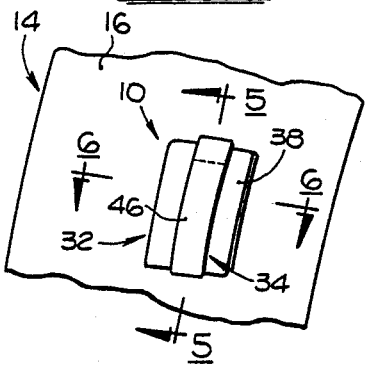
Fig. 5
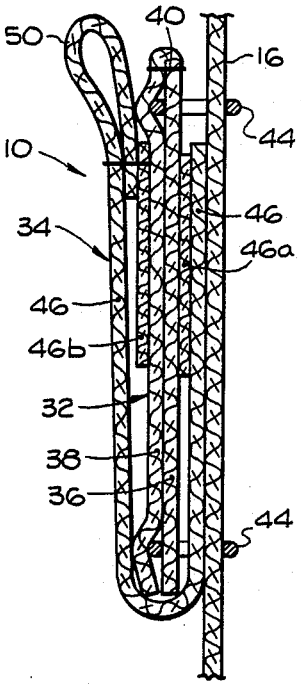
(EXAGGERATED THICKNESS)
Fig. 6
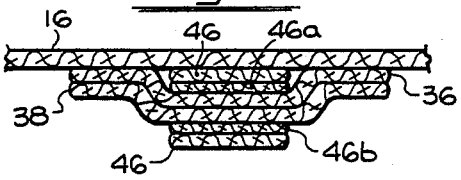
(EXAGGERATED THICKNESS)
Fig. 7
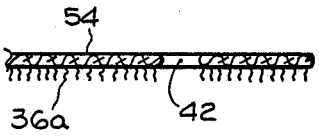
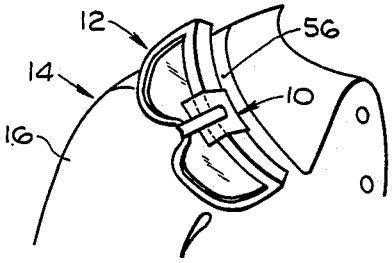
Fig. 8

SKI GOGGLE ARM CLIP

This invention is covered by Disclosure Document Report, No. 216340, recorded in the U.S. Patent and Trademark Office, on Dec. 19, 1988.

FIELD OF THE INVENTION

The invention relates to accommodating a second:, or alternative, eye protection, such as in the case of skiing. Extra eye wear is secured to the person, i.e. to the jacket or outer garment worn by the skier. Alpine skiers generally carry two types of eye wear, i.e. goggles and sun glasses. The goggles are for snowy or cloudy weather, and the sun glasses for bright and sunny days. Since the weather is often unpredictable, as in the mountains, most skiers will carry both kinds, but heretofore it has been a serious problem as to how to carry the eye wear that is not is use. Sun glasses are usually small and compact enough to fit into a jacket pocket, but when wearing sun glasses on bright days, the goggles are more difficult to accommodate. Usually they are worn on top of the head or around the neck. This is uncomfortable, and there is danger of possible accident to the body of the person, or loss of the goggles. Ordinarily goggles are relatively large and they cannot be easily accommodated in a pocket.

OBJECTS OF THE INVENTION

A main object of the invention is to provide means for securing a pair of goggles to the clothing of the user, having the following features and advantages:

1. The goggles are secured to the exterior of the clothing of the user, such as on the jacket, in such a manner as to eliminate the necessity for carrying them in the pocket of the jacket, or otherwise in an uncomfortable position, and wherein the goggles withstand extraneous forces tending to dislodge them, whereby to eliminate accidental loss thereof.

2. The goggles when so mounted, do not interfere in any way with the body movements of the skier.

3. The goggles can be easily fitted to the clothing of the skier according to the shape of an element of the body and the shape of the goggles, for greatly minimizing any tendency to dislodge the goggles.

4. The device is flexible and thereby it can be easily fitted to the clothing, and it can be secured to the clothing in a very secure manner, and easily and readily so.

5. The device is of relatively small dimension whereby to enable it to be secured to the bridge of the goggles, which is of small dimensions, and this arrangement assures continuous securement in position, and against dislodgement of the goggles therefrom, because of the relatively small dimensions of the bridge, and the confinement thereof between larger elements of the goggles.

6. The device is small and compact and inexpensive and is easily applied to the jacket of the wearer, and further it is relatively inconspicuous when not in use holding goggles, and when not in such use, it can serve an alternative purpose of bearing a decoration, monogram, etc.

DESCRIPTION OF A PREFERRED EMBODIMENT

In the drawings,

FIG. 1 is a perspective view of the clip of the invention in use, attached to the garment of the user and securing the goggles in position.

FIG. 2 is a perspective view of the clip itself, in open position as viewed from the front.

FIG. 3 is a perspective view of the clip itself in open position as viewed from the rear.

FIG. 4 is a view of the clip secured to the garment of the wearer, but without holding the goggles, and with the clip in folded position.

FIG. 5 is a sectional view taken at line 5—5 of FIG. 4.

FIG. 6 is a sectional view taken at line 6—6 of FIG. 4.

FIG. 7 is a sectional view taken at line 7—7 of FIG. 2.

FIG. 8 is a perspective view of the clip mounted on the shoulder of the garment and securing the goggles, this in contrast to FIG. 1 which shows the clip mounted on the sleeve of the garment.

Referring in detail to the drawings, attention is directed first to FIG. 1 which includes the clip of the invention, indicated at 10 securing a pair of goggles 12 to the jacket or garment 14 of the wearer. In this case it is secured to the sleeve 16 of the jacket.

Details of the clip 10 itself are set out hereinbelow, but in fully describing the construction and function of the clip, certain features of the goggles are first referred to, for convenience. The goggles 12 include a frame 18 having side portions 20 in which are mounted lenses 22. Interconnecting the side frame portions is a bridge or nose piece 24 which fits over the nose when the goggles are worn. The bridge 20 is of minor dimension in depth, i.e. vertically as viewed in FIG. 1, and the side portions 20 thereby form a nose notch 26. The small depth direction of the bridge is of significance in the functioning of the clip, as will be referred to again hereinbelow.

The pair of goggles 12, as will be understood, are curved to fit the head or face of the wearer, this curvature being indicated at 28 which is referenced to an axis 30 which is in upright position when the goggles are worn. The clip of the invention is designed and utilized to accommodate this curvature to the curvature of different parts of the body, and hence the jacket, of the wearer, in the present instance (FIG. 1), that curvature of the user's arm accommodating the curvature of the goggles.

Reference is next made to FIGS. 2 and 3 for detail construction of the clip of the invention. The clip includes two main parts, namely a back strap 32 and a securing strap 34. The back strap 32 is made up of a back flap 36 and a front flap 38 which may be separate pieces secured together at the top as by stitching, as indicated at 40. Alternatively, these flaps may be of one piece and folded, within the scope of the invention.

The back strap 32 and securing strap 34 are each made up of, or have as components of, what is known as hook and loop materials, which are smooth on one face and have tentacles on the other face, the pieces being held together when the latter faces are fitted together. The flaps themselves of the back strap 32 are fitted together so that the smooth surfaces **36*b*, 38*b*, thereof interface, with the loop sides 36*a*, 38*a*, directed oppositely outwardly from each other. The pieces 32 and 34** are however detachable by merely pulling them apart, but in the ordinary usage thereof, extraneous forces do not, or only seldom, pull them apart.

The back strap 32, that is, the two flaps fitted against each other, is of relatively broad dimensions, being substantially wider than the securing strap 34. The back flap 36 is provided with holes 42 adjacent the corners through which pins 44 are inserted for detachably securing the strap to the garment. These pins may be ordinary safety pins.

The narrow securing strap 34 is extended through the small nose notch 26 of the goggles and produces an unusual effect in securing the goggles in place. The securing strap 34 is preferably of ordinary stretchable material and short strips or pieces of hook material 46, identified **46*a*, 46*b*, are secured thereto on one side thereof, adjacent the ends 34*a*, 34*b*, of the strap. The securing strap may alternatively be of non-stretchable material, or it may include only a segment of stretchable material. Alternatively, it may be entirely of hook material, in the latter case of course eliminating the need for the strips 46*a*, 46*b***. Additionally the securing strap may if desired be sewed to the back strap.

The securing strap is secured to the back strap, in the preferred form, by fitting the piece of hook material **46*a* at one end to the loop material 36*a* on the back flap 36, and then it is extended downwardly beyond the back strap and folded upwardly and the hook material 46*b* at the other end is fitted against the loop material 38*a* on the front flap 38**.

In applying the clip to the sleeve of the jacket, it is oriented according to FIG. 2, and applied directly to the jacket, this orientation being also represented in FIG. 1. In this step, the inner end **34*a* of the securing strap is first fitted to the flap 36 as referred to, and then the clip is fitted against the sleeve. Then the pins 44 are inserted through the material of the sleeve from the inner side, and through the holes 42** and then again through the material of the sleeve.

As the next step, the goggles are fitted to the sleeve, with the bridge between the back and front flaps of the back strap, as represented in FIG. 1, and then the outer end **34*b* of the securing strap is fitted through the nose notch 26 and brought outwardly and upwardly over the bridge of the goggles and fitted against the front flap 38, and in this position, the hook material 46 on the securing strap engages the loop material 38*a* on the front flap. FIGS. 5 and 6** show well the positioning and interrelation of the various elements when the clip is applied to the jacket and in folded-up form.

The securement between the loop material and the hook material is very effective, and if any extraneous forces are exerted on the goggles, when they are so secured, the tendency to dislodge the securing strap from the front strap is substantially always in direction longitudinally or linearly along the securing strap, and the resistance to such dislodgement is great. Because the engagement of the clip with the goggles is on the bridge, and thus at the narrowest part of the goggles, there is no possibility of the goggles being shifted endwise out of the clip, i.e. endwise of the goggles. Furthermore, because of this securement at the narrow part of the goggles, the goggles can be accidentally twisted to a very great extent without dislodgement of the goggles from securement. Furthermore, the goggles remain firmly secured when the jacket is removed from the wearer and in handling the jacket when off the wearer.

The curvature of the goggles, at 28, is utilized in making the clip unusually effective. Because of this curvature, and similar curvature of the arm, and sleeve, the goggles fit snugly against the sleeve, and in this positioning, the bridge also is positioned closely against the sleeve, this in contrast to where the goggles may be positioned against a relatively flat surface. In the present case, because of the close positioning, the linear dimension of the clip is at an absolute minimum, and thus the arrangement is very compact, and relatively safe from entanglement from outside elements, as compared with a condition in which the clip would necessarily be of great linear dimensions.

Notwithstanding the great resistance of the hook and loop materials to separation by accidental extraneous forces, the user can easily separate them, to remove the goggles, by merely grasping the outer end of the securing strap and pulling away from the front flap, that direction being close to perpendicular to the surfaces of the straps. For convenience, a loop 50 may be formed in the outer end **34*b***, for easy grasping, and for appearance sake.

Although the clip may be secured to the garment as by the pins 42, it is within the scope of the invention to stitch the back flap around its perimeter, to the sleeve, as indicated at 52 in FIG. 2, thus forming a semi-permanent securement. It is further within the scope of the invention to incorporate the clip in the garment in the original fabrication of the garment.

As noted above, the details of construction of the securing strap 34 may be varied, with a corresponding effective variation of the length thereof, for accommodating goggles of different sizes. This may be done in the following ways a, b, and c. (a) In the case of the stretchability, it can be merely stretched to the desired length. (b) The inner end **34*a* may be selectively placed at a higher or lower position on the back flap, with respectively lesser or greater effective length. (c) The outer end 34*b* may be placed higher or lower on the front flap, resulting in corresponding effective lengths of the securing strap. Features (b) and (c) are effective in each the case of stretchable or non-stretchable material. Additionally, in the case where the inner end 34*a* is sewn to the back strap, features (b) and (c) are effective, and in any case feature (c) is effective. The material of the back strap 32 is quite flexible, but it does have a limited amount of rigidity, i.e. sufficient that it tends to lie flat. Referring to FIG. 7, it includes a base element 54 of heavy cloth on which the tentacles 38*c*** are secured. This base element provides the limited rigidity referred to.

The clip of the invention possesses an unusual feature, and that is, it is unobtrusive. When the goggles are not being carried, it is merely folded into a flat position, as shown in FIG. 4, with all of the parts fitted flat. All of the parts are very thin, relative to the outline dimensions of the device, and the entire clip appears as a flat patch when it is folded together as in FIG. 4. The clip may be of any of various colors, as a decorative feature, or it may be utilized for imprinting thereon a monogram, etc.

The holes 42 (FIG. 7) in the back flap are easily formed, as by a punch, or driving a needle through the material. The holes are formed in the base material 54, and this base material may be of such selected character that the holes can be formed by plunging a hot needle therethrough to form the hole of the size desired In the latter case, the edges of the hole seal up, and do not require any additional step to prevent raveling.

Although the goggles may be mounted conveniently on the sleeve of the jacket of the wearer, it is pointed out that the curvature of the shoulder is similar to that of the goggles, and that the goggles may be mounted on the shoulder 56 in a similar manner, as represented in FIG. 8, and all of the advantages referred to above in connection with the correlating curvature of the goggles and arm, apply in the present case as well. It will of course be understood that the invention is not limited to securing the goggles in any particular location.

I claim:

1. A clip for mounting goggles that have a frame and lenses mounted therein and a bridge for interconnecting the portions of the frame containing the lenses and having a nose notch below the bridge, comprising, a back strap for securement to the sleeve of a jacket, and having an inner flap having means for engaging the jacket and an outer flap, a securing strap having an inner end secured to the inner flap of the back strap, and an outer portion terminating in an outer end, and capable of being extended through the nose notch and placed around the bridge of the goggles, in confining relation to the bridge and the thereby the goggles, the straps are separate pieces and have hook and loop securing surfaces respectively, which are capable of holding together when put in mutually engaging position, the flaps of the back strap have respectively opposed such securing surfaces directed outwardly away from each other, the securing strap has portions of such securing surfaces on a single side thereof adjacent the ends thereof, the back strap is relatively wide and engageable with the sleeve throughout a correspondingly broad area, and the securing strap is relatively narrow and forms a correspondingly small element capable of fitting in the nose notch of the goggles, whereby, in response to the ends of the securing strap being fitted against the respective back flap and front flap, the respective hook and loop securing surfaces interengage and are thereby operable for detachably securing the securing strap to the back strap.

2. A clip for mounting goggles that have a frame and lenses mounted therein and a bridge for interconnecting the portions of the frame containing the lenses and a nose notch below the bridge, comprising, a wide back strap wider than the nose notch, and having an inner flap and an outer flap secured together at the top and being loose and separable elsewhere, the back flap having means for securement to a jacket for thereby securing the clip to the jacket, a securing strap capable of being fitted in the nose notch, the straps are separate pieces and have hook and loop securing surfaces thereon, respectively, namely, (a) the back strap having said securing surfaces on its opposed and outer surfaces, and (b) the securing strap having said securing surfaces at least on areas adjacent its ends, and the hook and loop surfaces on the straps being capable, when they are in interengagement, of detachably securing the respective flaps together, whereby the securing strap is capable of having its ends detachably secured to the outer surfaces and extended through the nose notch for holding the goggles in the clip.

3. A clip according to claim 2 wherein, the securing strap is relatively narrow includes at least a portion of elastic material enabling it to be extended to accommodate and hold goggles of various sizes.

4. A clip according to claim 2 wherein, the back strap is made of material that is flexible but has a limited amount of rigidity whereby it tends to lie flat, the back flap and the front flap of the back strap are separate pieces secured together in such manner that they lie flat throughout their areas.

5. A clip according to claim 4 wherein, the material of the back strap is relatively heavy, aiding in the flaps thereof to normally assume a flat condition, the back flap having permanent holes formed therein adjacent the corners thereof, and the clip includes pins extended through the material of the jacket for detachably securing the clip to the jacket.

6. A clip according to claim 2 in combination with a jacket and including, means to semi-permanently secure the clip to the jacket including stitching securing the back flap to the jacket.

* * * * *